US012465132B2

(12) United States Patent
Zheng et al.

(10) Patent No.: US 12,465,132 B2
(45) Date of Patent: Nov. 11, 2025

(54) WIPER FOR A COSMETIC PACKAGE

(71) Applicant: APR Beauty Group Inc, Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Toronto (CA)

( * ) Notice: Subject to any disclaimer, the term of this patent is extended or adjusted under 35 U.S.C. 154(b) by 128 days.

(21) Appl. No.: 18/632,212

(22) Filed: Apr. 10, 2024

(65) Prior Publication Data

US 2025/0318627 A1 Oct. 16, 2025

(51) Int. Cl.
*A45D 34/04* (2006.01)

(52) U.S. Cl.
CPC ..... *A45D 34/047* (2013.01)

(58) Field of Classification Search
CPC .. A45D 34/042; A45D 34/043; A45D 34/045; A45D 34/046; A45D 34/047; A45D 34/048; A45D 34/06; A45D 40/18; A45D 40/262; A45D 40/264; A45D 40/265; A45D 40/267; A45D 40/268
See application file for complete search history.

(56) References Cited

U.S. PATENT DOCUMENTS

| | | | | |
|---|---|---|---|---|
| 4,403,624 | A | 9/1983 | Montgomery | |
| 5,803,638 | A | 9/1998 | Gueret | |
| 9,004,075 | B2 * | 4/2015 | Pires | A45D 34/046 401/122 |
| 2002/0195117 | A1 * | 12/2002 | Bailly | A45D 40/267 132/218 |
| 2010/0129132 | A1 * | 5/2010 | Pires | A45D 40/267 401/121 |
| 2013/0101335 | A1 * | 4/2013 | Kulik | A45D 34/046 401/122 |
| 2013/0101337 | A1 * | 4/2013 | Kulik | A45D 40/267 401/122 |

* cited by examiner

*Primary Examiner* — Rachel R Steitz
*Assistant Examiner* — Karim Asqiriba
(74) *Attorney, Agent, or Firm* — Jason L DeFrancesco

(57) ABSTRACT

A wiper associated with a cosmetic package for wiping a rod and an applicator part attached to the rod. The wiper comprises a hollow tubular body with a circumferential wiping lip extending inwardly into a hollow interior of the hollow tubular body. The circumferential wiping lip has an inner and outer surface, defining a first wiping orifice. The outer surface features uniformly spaced teeth having a downward and inward curvature towards a longitudinal axis of the wiper. Each tooth has two opposing main surfaces, an inner lateral surface and an outer lateral surface. The outer lateral surface has at least two concave notches. The teeth collectively form a second wiping orifice smaller than the first.

17 Claims, 4 Drawing Sheets

WIPER FOR A COSMETIC PACKAGE

BACKGROUND

Field

The present description relates to a wiper for wiping a liquid or paste applicator. The applicator may be adapted to a cosmetic, e.g. it may be a mascara brush, or it may be adapted to any liquid or paste for application to a surface by a brush, or the like.

Description of the Related Art

Numerous designs of wipers have been revealed in prior art. Typically, these wipers take the form of sleeves or tubular elements tapering at one end, resembling a truncated cone in its broadest interpretation. The truncated cone-shaped portion forms a wiper lip extending in the circumference direction, usually in a fully closed manner or divided into closely spaced segments of a circle. For example, U.S. Pat. Nos. 4,403,624 and 5,803,638A disclose examples of wipers of the prior art.

When designing a wiper lip, consideration has to be given to leave enough space for the diameter of the rod and as well as to the bristles of the applicator. Often, using applicators involves a trade-off. If the inner diameter of the wiper lip of such a wiper is relatively large, it doesn't offer much resistance when removing the applicator but retains a significant amount of cosmetic compound in the set of bristles. Conversely, when the inner diameter of the area enclosed by the wiper lip is noticeably smaller than the diameter of the rod, the actual applicator section is wiped more forcefully. However, this increases the resistance when pulling the applicator out through the wiper.

This trade-off often necessitates maintaining a particular diameter ratio between the applicator rod and the core supporting the bristles, limiting design possibilities.

By way of example, US patent No. 2013/0101337 discloses a wiper device for a cosmetic applicator, which wiper comprises a tubular body having an axis, and a plurality of blades that extend from the tubular body and that are arranged around the axis. Each blade comprises a proximal end that is close to the tubular body, a distal end, and an intermediate portion. In particular, each blade includes a fin that extends radially, perpendicularly to the axis and towards the axis, the fins of the various blades being situated at various distances from the tubular body.

The objective of the invention is to create a novel wiper design that allows variable wiping.

SUMMARY

Accordingly, there is provided a wiper design that allows variable wiping. Particularly, the structure of the wiper allows satisfactory wiping of both a rod and an applicator part that is attached to the rod. According to an aspect of the present embodiment, the wiper is component of a cosmetic package designed for dispensing and applying liquid or pasty products like a lip product or mascara. This package comprises a product reservoir, which could be a bottle, such as a glass one, with a neck or collar ending in external threading. To seal the product reservoir, a cap with internal threading is provided. This threading matches the threaded end of the neck.

According to another aspect of the present disclosure, the cap includes an inner cap member, which in this case features a transverse wall that fits tightly over the neck's end to prevent leaks. The cosmetic package extends along a longitudinal axis. The cap is provided with an applicator part, extending into the product reservoir when the cap is in the closed position. The applicator part is mounted on the bottom end of a rod, which itself is integral with the transverse wall of the cap and coaxial with the cap. The rod is coaxial with the neck when the cap is in the closed position.

According to another aspect of the present disclosure, the applicator part may be a brush or an applicator made of an elastomeric material, a flock-coated plastic material, felt, foam or any other material suitable for applying the product.

According to another aspect of the present disclosure, the neck of the product reservoir is equipped with the wiper made of an elastically deformable material in which the rod of the applicator part sits when the cap is secured to the neck of the product reservoir.

According to yet another aspect of the present disclosure, the wiper has a hollow tubular body that tapers slightly towards a lower end thereof. The hollow tubular body of the wiper terminates in an upper orifice at an upper end thereof and terminates in a lower orifice at a lower end thereof. The lower orifice defines a first wiping orifice. The wiper further includes attachment features such as a circumferential retention bead on outer circumference of the hollow tubular body. In order to fit the wiper in the neck of the product reservoir, the circumferential retention bead formed on the circumference of wiper slide into an annular groove formed in the neck of the product reservoir. Such a connection allows the wiper to remain in place when the applicator part is withdrawn from the product reservoir and wiped.

According to yet another aspect of the present disclosure, the wiper further includes an annular flange at the upper end thereof. The annular flange at the upper end of the wiper rests on a free edge of the neck of the product reservoir, when the wiper is mounted on the product reservoir.

According to yet another aspect of the present disclosure, inside a hollow interior of the wiper, a circumferential wiping lip extends radially inwardly towards the longitudinal axis of the wiper from the lower end of the hollow tubular body of the wiper. The circumferential wiping lip features a central opening with an interior edge, the interior edge defining the first wiping orifice.

Furthermore, the circumferential wiping lip comprises of an inner surface and an outer surface. The outer surface is predominantly flat and inclined, originating from the lower end of the hollow tubular body and ending at an interior edge of the wiping lip defined by the first wiping orifice. The outer surface of the circumferential wiping lip exhibits a frustum of cone shape. Furthermore, the outer surface converges towards the inner surface of the circumferential wiping lip. In other words, the outer surface slants inwardly towards the inner surface. On the other hand, the inner surface has a slightly concave profile, originating from an inner surface of the hollow tubular body and terminating at the first wiping orifice.

According to yet another aspect of the present disclosure, the outer surface of the circumferential wiping lip includes a plurality of teeth, uniformly spaced and arranged in a circumferential manner on the outer surface. Each tooth exhibits a downward and inward curvature towards the longitudinal axis of the wiper. The free edges of these teeth collectively form a second wiping orifice, characterized by a diameter smaller than that of the first wiping orifice. The first wiping orifice have a diameter ranging between 3-5 mm and the second wiping orifice have a diameter ranging between 2-4 mm. Preferably, the diameter of first wiping orifice is between 3.8-4.8 mm and the diameter of the second wiping orifice is between 2.6 mm-3.6 mm.

According to yet another aspect of the present disclosure, at least one of the teeth includes two main opposing surfaces, and two opposing lateral surfaces. The two main opposing surfaces, are both flat and have identical shapes. Conversely, the two opposing lateral surfaces, are non-identical. Specifically, the tooth has an outer lateral surface and an inner lateral surface. The outer lateral surface of the tooth lies closer to the lower end of the hollow tubular body than to the first wiping orifice, while the inner lateral surface is situated closer to the first wiping orifice than to the lower end of the hollow tubular body. The outer lateral surface meets the inner lateral surface to form a free edge at a tip thereof. The outer lateral surface has a convex arch along a length thereof that converge to meet the inner lateral surface. The inner lateral surface has concave-arch along its length. The radius of curvature of the outer lateral surface is significantly smaller than that of the inner lateral surface, resulting in a more pronounced curvature in the outer lateral surface compared to the inner lateral surface.

Furthermore, at least one of the teeth has at least two concave notches, formed on the outer lateral surface thereof, designed to enhance the flexibility of the tooth. The two concave notches, are positioned consecutively along the length of the outer lateral surface, without a gap and therefore, sharing a one common edge between them. Each of the two concave notches, extends across the entire width of the outer lateral surface. Preferably, the two concave notches are situated away from an upper end and a lower end of the tooth.

In a preferred embodiment, each tooth has a base region through which it is attached to the circumferential wiping lip, the base region extends across a complete width of the circumferential wiping lip. However, in alternate embodiment, the base region of the tooth may not extend over the entire width of the circumferential wiping lip.

In the preferred embodiment, all the teeth exhibit uniformity in both shape and size. However, in alternate embodiments, at least one tooth may deviate in either shape or size from the remaining teeth.

Further, various embodiments, the two concave notches and are/may not be identical in their sizes in terms of at least one of their lengths, breadths or depths.

In the preferred embodiment, the teeth are integrally formed with the wiper by injection molding.

In the preferred embodiment, there are six teeth, however, in other alternate embodiments, the number of teeth may more or less than six.

During use, when the applicator part is withdrawn from the wiper, the first wiping orifice wipes the rod, while the second wiping orifice effectively wipes the extra product deposited on the applicator/brush and/or between the bristles of a brush. During insertion of the applicator part and the rod into the product reservoir, the flexibility of the teeth allows easy insertion of the applicator part and the rod.

In the present embodiment, a length of each of teeth is between 3-5 mm, preferably 3-4 mm. A maximum width of each of teeth is between 0.5-1.5 mm, preferably about between 1-1.5 mm.

The rod and the cap may be obtained by molding a thermoplastic material chosen from polyolefins, polypropylenes (PP), polyethylene terephthalates (PET) or a high-density polyethylene (HDPE). The thermoplastic material may be introduced into the mould by injection.

The cap can be fastened on the container by snap-fastening or by some other means known in the art.

Additional advantages, features, characteristics and aspects of the present invention follow from the claims and the following description of a preferred embodiment with reference to the drawing.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
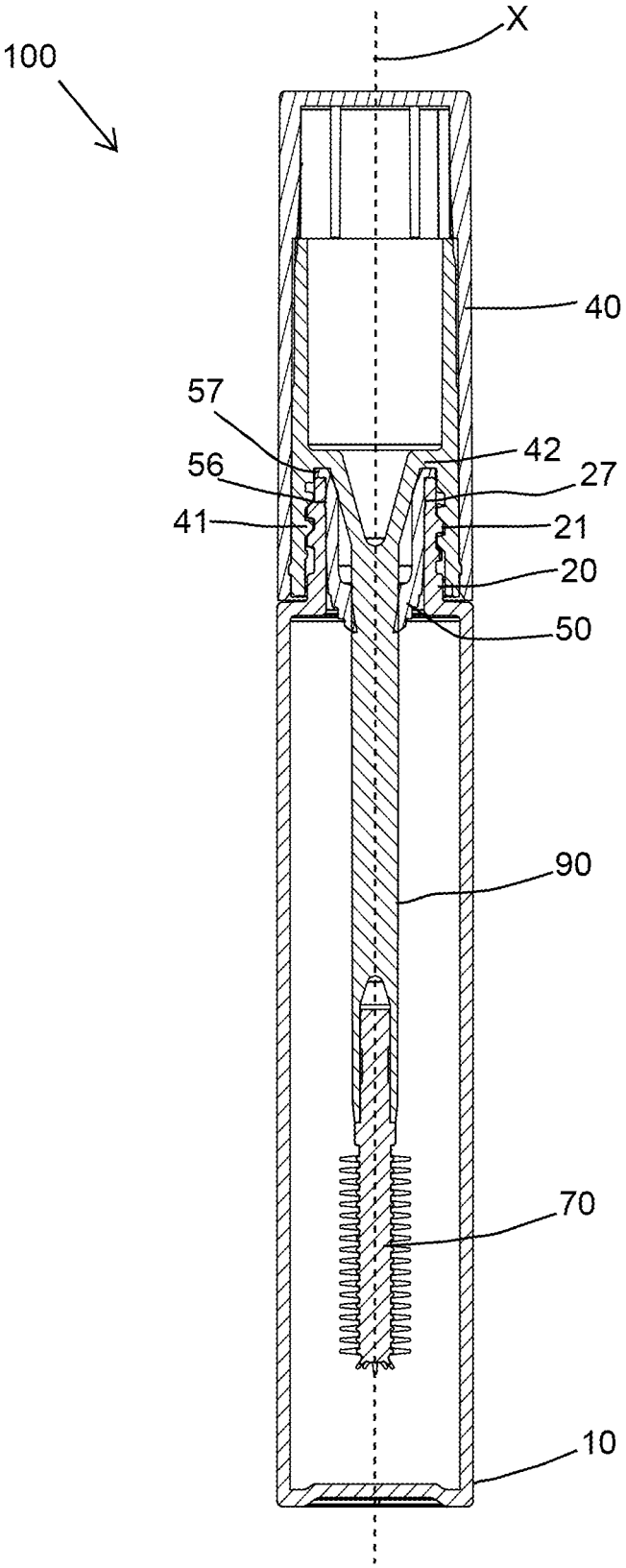
FIG. 1 illustrates a longitudinal cross-sectional view of a cosmetic package according to a preferred embodiment of the present disclosure.
Figure 2:
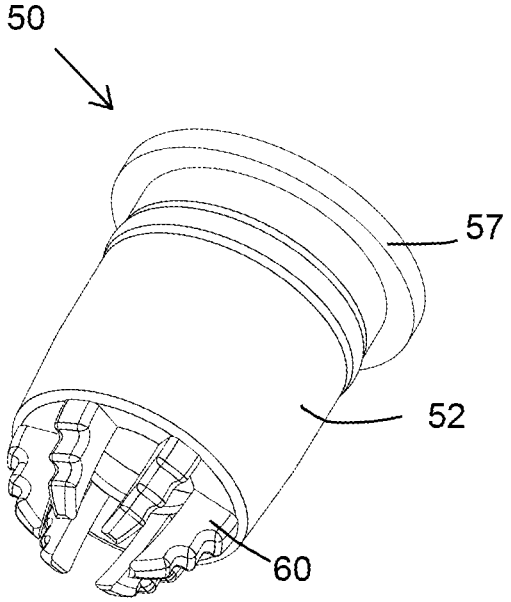
FIG. 2 illustrates a perspective view of a wiper of the cosmetic package of FIG. 1.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a system or method that "comprises," "has," "contains," or "includes" one or more elements possesses those one or more elements, but is not limited to possessing only those one or more elements or steps. Likewise, an element of a system or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

Referring to FIG. 1, which illustrates a cosmetic package 100 designed for dispensing liquid or pasty products like a lip product or mascara. This package 100 comprises a product reservoir 10, which could be a bottle, such as a glass one, with a neck 20 or collar ending in external threading 21. A cap 40 with internal threading 41 is provided to seal the reservoir 10. This threading 41 matches the threaded end 21 of the neck 20. The cap 40 includes an inner cap member 42, which in this case features a transverse wall 42 that fits tightly over the neck's end 20 to prevent the product leakage. The cosmetic package 100 extends along a longitudinal axis X.

The cap 40 is provided with an applicator part 70, extending into the reservoir 10 when the cap 40 is in the closed position as illustrated in FIG. 1.

The applicator part 70 is mounted on the bottom end of a rod 90, which itself is integral with the transverse wall 42 of the cap 40 and coaxial with the cap 40. The rod 90 is coaxial with the neck 20 when the cap 40 is in the closed position.

The applicator part 70 may be a brush or an applicator made of an elastomeric material, a flock-coated plastic material, felt, foam or any other material suitable for applying the product.

The neck 20 of the reservoir 10 is equipped with a wiper 50 made of an elastically deformable material in which the rod 90 of the applicator part 70 sits when the cap 40 is secured to the neck 20 of the reservoir 10.

Referring to FIGS. 2-6, the wiper 50 has a hollow tubular body 52 that tapers slightly towards a lower end thereof. The hollow tubular body 52 of the wiper 50 terminates in an upper orifice 54 at an upper end thereof and terminates in a lower orifice 55 at a lower end thereof. The lower orifice 55 defines a first wiping orifice 55. The wiper 50 further includes attachment features such as a circumferential retention bead 56 on outer circumference of the hollow tubular body 52. In order to fit the wiper 50 in the neck 20 of the reservoir 10, the circumferential retention bead 56 formed on the circumference of wiper 50 slide into an annular groove 27 formed in the neck 20 of the reservoir 10, refer FIG. 1. This allows the wiper 50 to remain in place when the applicator part 70 is withdrawn from the reservoir 10 and wiped.

The wiper 50 further includes an annular flange 57 at the upper end thereof. The annular flange 57 at the upper end of the wiper 50 rests on a free edge of the neck 20 of the reservoir 10, when the wiper 50 is mounted on the reservoir 50, refer FIG. 1.

Inside a hollow interior 53 of the wiper 50, a circumferential wiping lip 58 extends radially inwardly from the lower end of the hollow tubular body 52 of the wiper 50.

The circumferential wiping lip 58 features a central opening with an interior edge, the interior edge defining the first wiping orifice 55.

Figure 5:
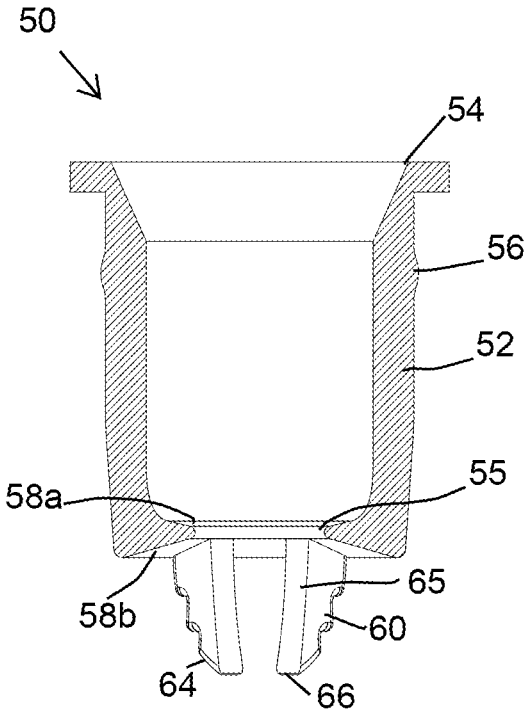
FIG. 5 illustrates a longitudinal cross-sectional view of the wiper of FIG. 2.
Figure 6:
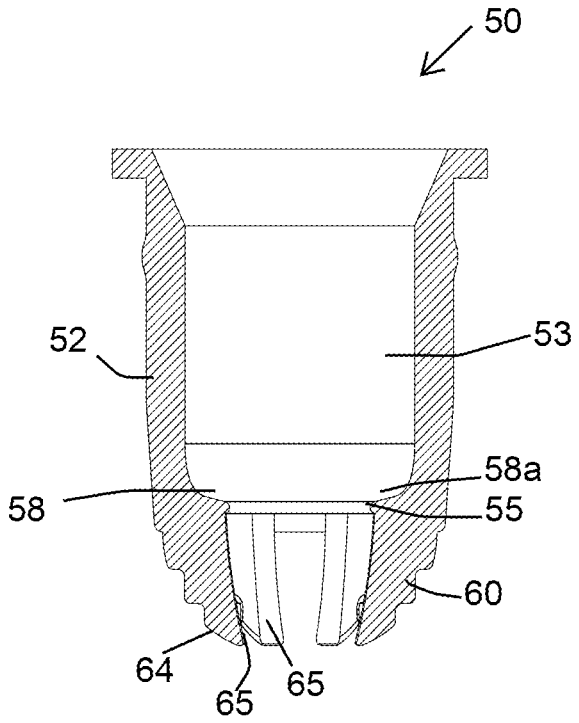
FIG. 6 illustrates another longitudinal cross-sectional view of the wiper of FIG. 2.
Figure 7:
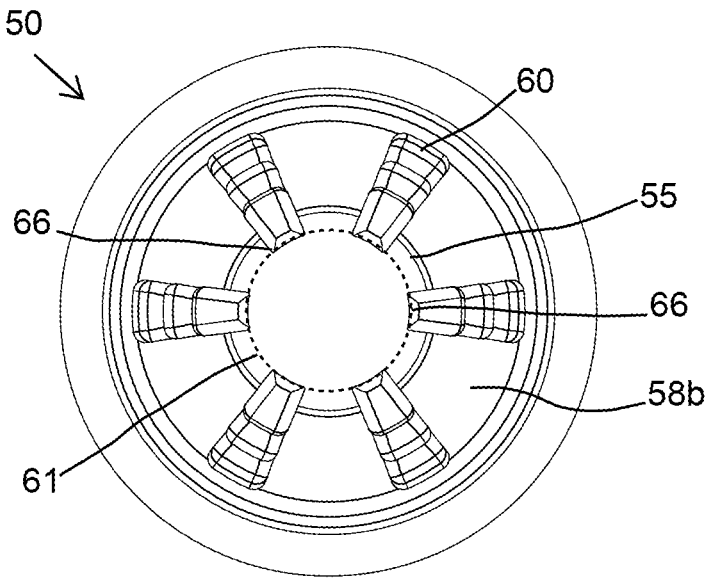
FIG. 7 illustrates a bottom view of the wiper of FIG. 2.
Figure 8:
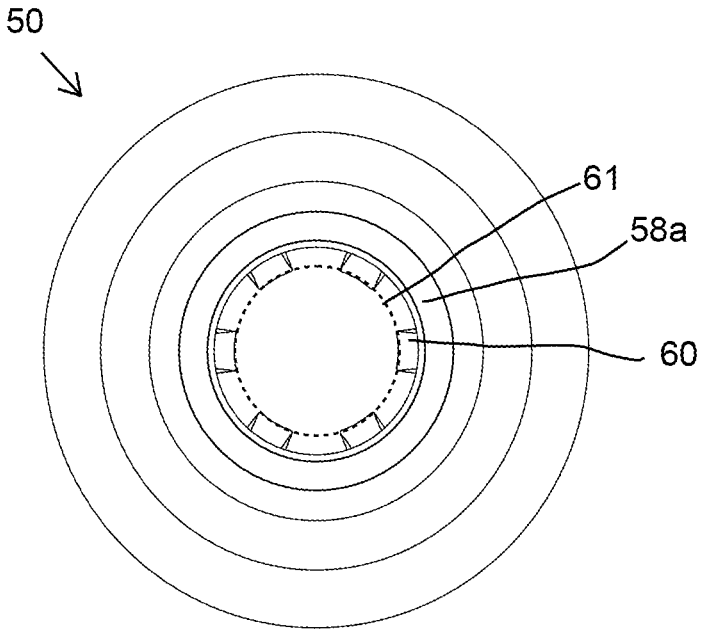
FIG. 8 illustrates a top view of the wiper of FIG. 2.

Furthermore, the circumferential wiping lip 58 comprises of an inner surface 58*a* and an outer surface 58*b*. As seen in FIG. 5 showing the longitudinal cross-section of the wiper 50, the outer surface 58*b* is predominantly flat and inclined, originating from the lower end of the hollow tubular body 52 and ending at an interior edge of the circumferential wiping lip 58 defined by the first wiping orifice 55. The outer surface 58*b* of the circumferential wiping lip 58 exhibits a frustum of cone shape. Furthermore, the outer surface 58*b* converges towards the inner surface 58*a* of the circumferential wiping lip 58. On the other hand, as seen in FIG. 6, the inner surface 58*a* has a slightly concave profile, originating from an inner surface of the hollow tubular body 52 and terminating at the first wiping orifice 55.

Referring to FIGS. 2-8, the outer surface 58*b* of the circumferential wiping lip 58 includes a plurality of teeth 60, uniformly spaced and arranged in a circumferential manner on the outer surface 58*b*. Each tooth 60 exhibits a downward and inward curvature towards the longitudinal axis X of the wiper 50. The free edges 66 of these teeth 60 collectively form a second wiping orifice 61 (FIGS. 7 and 8), characterized by a diameter smaller than that of the first wiping orifice 55. The first wiping orifice 55 have a diameter ranging between 3-5 mm and the second wiping orifice 61 have a diameter ranging between 2-4 mm. Preferably, the diameter of first wiping orifice 55 is between 3.8-4.8 mm and the diameter of the second wiping orifice 61 is between 2.6 mm-3.6 mm.

Figure 4:
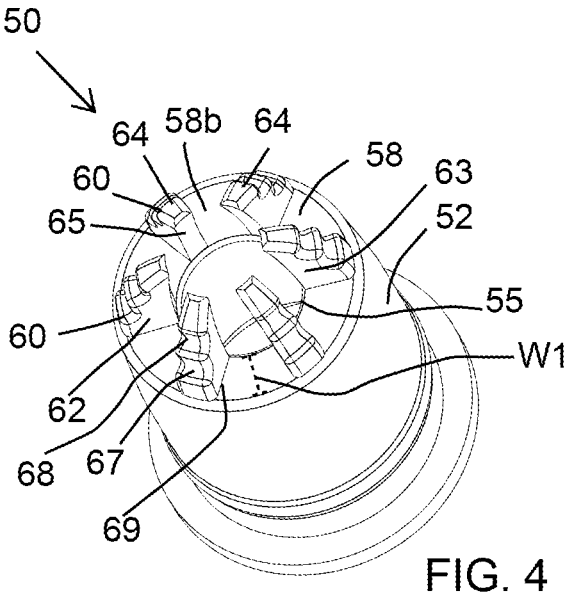
FIG. 4 illustrates a bottom perspective view of the wiper of FIG. 2.

As seen in the FIG. 4, at least one of the teeth 60 includes two main opposing surfaces 62, 63 and two opposing lateral surfaces 64, 65. The two main opposing surfaces 62, 63 are both flat and have identical shapes. Conversely, the two opposing lateral surfaces 64, 65 are non-identical. Specifically, the tooth 60 has an outer lateral surface 64 and an inner lateral surface 65. The outer lateral surface 64 of the tooth 60 lies closer to the lower end of the hollow tubular body 52 than to the first wiping orifice 55, while the inner lateral surface 65 is situated closer to the first wiping orifice 55 than to the lower end of the hollow tubular body 52. The outer lateral surface 64 meets the inner lateral surface 65 to form a free edge 66 at a tip thereof. The outer lateral surface 64 has a convex arch along a length thereof that converge to meet the inner lateral surface 65, refer FIG. 6. The inner lateral surface 65 has concave-arch along its length. The radius of curvature of the outer lateral surface 64 is significantly smaller than that of the inner lateral surface 65, resulting in a more pronounced curvature in the outer lateral surface 64 compared to the inner lateral surface 65.

Figure 3:
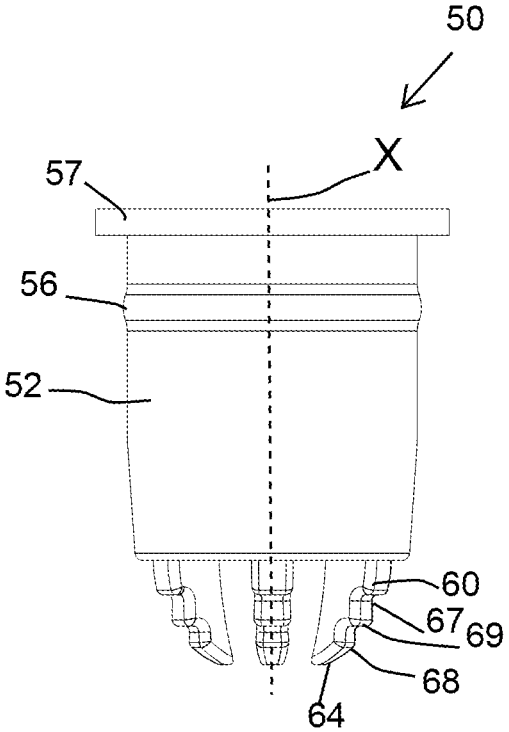
FIG. 3 illustrates a front view of the wiper of FIG. 2.

Furthermore, referring to FIGS. 3 and 4, at least one of the teeth 60 has at least two concave notches 67, 68 formed on the outer lateral surface 64 thereof, designed to enhance the flexibility of the tooth 60. The two concave notches 67, 68 are positioned consecutively along the length of the outer lateral surface 64, without a gap and therefore, sharing a one common edge 69 between them. Each of the two concave notches 67, 68 extends across the entire width of the outer lateral surface 64. As seen, both the two concave notches 67, 68 are situated away from an upper end and a lower end of the tooth 60.

In the exemplary embodiment, as shown in FIG. 4, each tooth 60 has a base region 69 through which it is attached to the circumferential wiping lip 58, the base region 69 extend across a complete width W1 of the circumferential wiping lip 58. However, in alternate embodiment, the base region 69 of the tooth 60 may not extend over the entire width of the circumferential wiping lip 58.

In the present embodiment, all the teeth 60 exhibit uniformity in both shape and size. However, in alternate embodiments, at least one tooth 60 may deviate in either shape or size from the remaining teeth 60.

Further, various embodiments, the two concave notches 67 and 68 are/may not be identical in their sizes in terms of at least one of their lengths, breadths or depths.

In the present embodiment, the teeth 60 are integrally formed with the wiper 50 by injection molding.

In the present embodiment, there are six teeth 60, however, in other alternate embodiments, the number of teeth 60 may more or less than six.

When the applicator part 70 is withdrawn from the wiper 50, the first wiping orifice 55 wipes the rod 90, while the second wiping orifice 61 effectively wipes the extra product deposited on the applicator/brush.

During insertion of the applicator part 70 and the rod 90, the flexibility of the teeth 60 allows easy insertion of the applicator part 70 and the rod 90 into the reservoir 10.

In the present embodiment, a length of each of teeth 60 is between 3-5 mm, preferably 3-4 mm. A maximum width of each of teeth 60 is between 0.5-1.5 mm, preferably about between 1-1.5 mm.

The rod 90 and the cap 10 may be obtained by molding a thermoplastic material chosen from polyolefins, polypropylenes (PP), polyethylene terephthalates (PET) or a high-density polyethylene (HDPE). The thermoplastic material may be introduced into the mould by injection.

The cap 10 can be fastened on the container 102 by snap-fastening or by some other means known in the art.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. A wiper for a cosmetic package, the wiper comprising:

a hollow tubular body having an upper end and a lower end;

a circumferential wiping lip extending radially inwardly from a lower end of the hollow tubular body into a hollow interior of the hollow tubular body;

wherein the circumferential wiping lip comprising an inner surface and an outer surface, the circumferential wiping lip further comprising a central opening with an interior edge defining a first wiping orifice;

wherein the outer surface slanting inwardly towards the inner surface of the circumferential wiping lip;

wherein a plurality of teeth uniformly spaced and arranged circumferentially on the outer surface of the circumferential wiping lip;

wherein each tooth of the plurality of teeth has a downward and inward curvature towards a longitudinal axis of the wiper;

wherein each tooth of the plurality of teeth comprising two main opposing surfaces, an outer lateral surface, and an inner lateral surface opposing the outer lateral surface;

wherein the outer lateral surface of at least one tooth being closer to the lower end of the hollow tubular body than to the first wiping orifice, and the inner lateral surface being closer to the first wiping orifice than to the lower end of the hollow tubular body;

wherein the outer lateral surface meeting the inner lateral surface to form a free edge at a tip of the tooth;

wherein the outer lateral surface having a convex arch along its length that converges to meet the inner lateral surface, and the inner lateral surface having a concave-arch along its length;

wherein a radius of curvature of the outer lateral surface being smaller than a radius of the inner lateral surface;

wherein the tooth further comprising at least two concave notches formed on the outer lateral surface thereof, wherein the two concave notches are positioned consecutively along the length of the lateral surface and extend across an entire width of the lateral surface; and wherein free edges of the plurality of teeth collectively forming a second wiping orifice, the second wiping orifice having a diameter smaller than a diameter of the first wiping orifice.

2. The wiper of claim 1, wherein the hollow tubular body tapers slightly towards a lower end thereof.

3. The wiper of claim 1, wherein the inner surface of the circumferential wiping lip has a slightly concave profile, originating from an inner surface of the hollow tubular body and terminating at the wiping orifice.

4. The wiper of claim 1, wherein the diameter of first wiping orifice is between 3.8-4.8 mm and the diameter of the second wiping orifice is between 2.6 mm-3.6 mm.

5. The wiper of claim 1, wherein the two main opposing surfaces, are both flat and have identical shapes.

6. The wiper of claim 1, wherein the two concave notches share a one common edge between them, and wherein the two concave notches are situated away from an upper end and a lower end of the tooth.

7. The wiper of claim 1, wherein the each tooth of the plurality of teeth has a base region through which it is attached to the circumferential wiping lip, the base region extends across a complete width of the circumferential wiping lip.

8. The wiper of claim 1, wherein all the plurality of teeth exhibit uniformity in both shape and size.

9. The wiper of claim 1, wherein the plurality of teeth is integrally formed with the wiper by injection molding.

10. The wiper of claim 1, wherein, a length of each of the plurality of teeth is between 3-4 mm; and wherein a maximum width of the each of the plurality of teeth is between 1-1.5 mm.

11. The wiper of claim 1, wherein the wiper is configured to be part of the cosmetic package; wherein the cosmetic package comprises a product reservoir, a cap, a rod and an applicator part; and wherein wiper is fitted into a neck of the product reservoir; the cap is attached to an upper end of the rod and the applicator is secured to a lower end of the rod.

12. The wiper of claim 11, wherein the wiper includes a circumferential retention bead on an outer circumference of the hollow tubular body; wherein to fit the wiper in the neck of the product reservoir, the circumferential retention bead formed on the outer circumference of wiper slide into an annular groove formed in the neck of the product reservoir.

13. A wiper for a cosmetic package, the wiper comprising:

a hollow tubular body having an upper end and a lower end;

a circumferential wiping lip extending radially inwardly from a lower end of the hollow tubular body into a hollow interior of the hollow tubular body;

wherein the circumferential wiping lip comprising an inner surface and an outer surface;

wherein the circumferential wiping lip further comprising a central opening with an interior edge defining a first wiping orifice;

wherein a plurality of teeth uniformly spaced and arranged circumferentially on the outer surface of the circumferential wiping lip;

wherein each tooth of the plurality of teeth has a downward and inward curvature towards a longitudinal axis of the wiper;

wherein the each tooth comprising two main opposing surfaces, an outer lateral surface, and an inner lateral surface opposing the outer lateral surface;

wherein the outer lateral surface meeting the inner lateral surface to form a free edge at a tip of the each tooth;

wherein the outer lateral surface having a convex arch along its length that converges to meet the inner lateral surface;

wherein the each tooth further comprising at least two concave notches formed on the outer lateral surface thereof; and wherein free edges of the plurality of teeth collectively forming a second wiping orifice, the second wiping orifice having a diameter smaller than a diameter of the first wiping orifice.

14. The wiper of claim 13, wherein the outer lateral surface of at least one tooth being closer to the lower end of the hollow tubular body than to the first wiping orifice, and the inner lateral surface being closer to the first wiping orifice than to the lower end of the hollow tubular body.

15. The wiper of claim 13, wherein the hollow tubular body tapers slightly towards a lower end thereof.

16. The wiper of claim 13, wherein the inner surface of the circumferential wiping lip has a slightly concave profile, originating from an inner surface of the hollow tubular body and terminating at the wiping orifice; and wherein the outer surface of the circumferential wiping lip is an inclined surface, originating from the lower end of the tubular body and ending at an interior edge of the wiping lip defined by the first wiping orifice.

17. A wiper for a cosmetic package, the wiper comprising:

a hollow tubular body having an upper end and a lower end;

a circumferential wiping lip extending radially inwardly from a lower end of the hollow tubular body into a hollow interior of the hollow tubular body;

wherein the circumferential wiping lip comprising an inner surface and an outer surface, the circumferential wiping lip further comprising a central opening with an interior edge defining a first wiping orifice;

wherein the outer surface slanting inwardly towards the inner surface of the circumferential wiping lip;

wherein a plurality of teeth uniformly spaced and arranged circumferentially on the outer surface of the circumferential wiping lip; wherein each tooth of the plurality of teeth has a downward and inward curvature towards a longitudinal axis of the wiper;

wherein the each tooth of the plurality of teeth comprising two main opposing surfaces, an outer lateral surface, and an inner lateral surface opposing the outer lateral surface;

wherein the outer lateral surface of at least one tooth being closer to the lower end of the hollow tubular body than to the first wiping orifice, and the inner lateral surface being closer to the first wiping orifice than to the lower end of the hollow tubular body;

wherein the outer lateral surface meeting the inner lateral surface to form a free edge at a tip of the each tooth;

wherein the outer lateral surface having a convex arch along its length that converges to meet the inner lateral surface, and the inner lateral surface having a concave-arch along its length;

wherein a radius of curvature of the outer lateral surface being smaller than a radius of the inner lateral surface;

wherein free edges of the plurality of teeth collectively forming a second wiping orifice, the second wiping orifice having a diameter smaller than a diameter of the first wiping orifice; and wherein the each tooth further comprising at least two concave notches formed on the outer lateral surface thereof; wherein the at least two concave notches share a one common edge between them.

* * * * *